US006272985B1

(12) United States Patent
Keller et al.

(10) Patent No.: US 6,272,985 B1
(45) Date of Patent: Aug. 14, 2001

(54) LINK ARM MECHANISM FOR ADJUSTABLE SPACING OF PLATE AND BLANKET CYLINDERS IN A ROTARY OFFSET PRINTING PRESS

(75) Inventors: James J. Keller, Scottsdale, AZ (US); Wallace E. Keller, Mount Horeb, WI (US)

(73) Assignee: Kelray Tech, Inc., Scottsdale, AZ (US)

( * ) Notice: Subject to any disclaimer, the term of this patent is extended or adjusted under 35 U.S.C. 154(b) by 0 days.

(21) Appl. No.: 09/391,296

(22) Filed: Sep. 7, 1999

(51) Int. Cl.[7] ..... B41F 5/18

(52) U.S. Cl. ..... 101/137; 101/140; 101/144; 101/145; 101/218; 101/247

(58) Field of Search ..... 101/218, 247, 101/216, 212, 219, 136, 137, 143, 144, 145, 140

(56) References Cited

U.S. PATENT DOCUMENTS

| | | | | |
|---|---|---|---|---|
| 3,749,011 | * | 7/1973 | Abendroth et al. | 101/148 |
| 3,964,387 | * | 6/1976 | Werner | 101/224 |
| 4,936,211 | | 6/1990 | Pensavecchia et al. | 101/136 |
| 5,161,463 | * | 11/1992 | Knauer et al. | 101/247 |
| 5,690,029 | * | 11/1997 | Herrmann et al. | 101/247 |
| 5,692,441 | * | 12/1997 | Michalik | 101/232 |
| 5,794,531 | | 8/1998 | Keller | 101/479 |

* cited by examiner

*Primary Examiner*—Daniel J. Colilla
(74) *Attorney, Agent, or Firm*—John W. Montgomery; Haynes and Boone, L.L.P.

(57) ABSTRACT

A link mechanism is provided for setting and maintaining a minimum spacial distance between a blanket cylinder and a plate cylinder of a rotary printing press. The link mechanism includes a first link arm that is rotatably mounted on an axle of the blanket cylinder at one of the blanket cylinder. A second link arm rotatably is mounted on an axle of the plate cylinder. The first link arm and the second link arm are pivotably connected to each other for single axis pivoting about a point offset to one side of an imaginary line drawn through centers of the plate cylinder axle and the blanket cylinder axle. An adjustment mechanism is positioned between the first and second link arms on projections offset to the other side of the imaginary line so that the set minimum spacial distance between the plate cylinder axles and the blanket cylinder axle can be adjustably set and maintained throughout impression rotation of the rotary printing press.

12 Claims, 4 Drawing Sheets

LINK ARM MECHANISM FOR ADJUSTABLE SPACING OF PLATE AND BLANKET CYLINDERS IN A ROTARY OFFSET PRINTING PRESS

TECHNICAL FIELD OF THE INVENTION

The present invention is directed to a mechanism for maintaining a proper minimum rolling contact spacing between a plate cylinder and a blanket cylinder, under printing pressure, in a sheet-fed, rotary offset printing press and, particularly, to an adjustable link arm mechanism for adjustably setting and maintaining a desired minimum spacial distance and maximum rolling contact pressure between plate and blanket cylinders of a rotary offset printing press.

BACKGROUND OF THE INVENTION

In a sheet-fed, rotary offset printing press, a plate cylinder is fitted with a thin sheet printing plate having the image to be printed photosensitized thereon. The printing plate is supplied with ink and dampening fluid, such that the ink is attracted and dampening fluid is propelled (hydrophobic) to appropriate parts of the photosensitized cylinder and the ink is repelled and the dampening fluid is attracted and coats (hydrophilic) the other parts. This forms an image. Through rolling contact with the blanket cylinder, the image is transferred to the blanket cylinder. The blanket cylinder rolls against an impression cylinder having a sheet of paper or other material to be printed gripped at a leading edge and wrapped around the surface of the impression cylinder. Through rolling contact under an impression force or rolling pressure, the blanket cylinder transfers the ink image onto the paper.

In a multiple color offset printing press, such as a three or four-color printing press, there is a plate cylinder and a blanket cylinder for applying each color with a dot pattern. Each plate for the plate cylinders is photosensitized (made hydrophobic) for attracting ink to dots positioned for applying a single color, or the appearance of a single color, on the final printing product. Typically, three primary colors are applied in a three-color printing press and black ink applied at a fourth printing head. In order to provide a clear, blended color picture, the registration or the positioning of each set of differently colored dots superimposed on the same sheet paper becomes a critical feature and requires each plate and blanket cylinder to be the same diameter, all sets to be synchronously geared to the impression cylinder and rolling contact pressure against the impression cylinder and a makeready position (relaxed pressure, non-contact). It also requires careful adjustment of rotation axial and skew orientation and appropriate contact pressure between the plate and blanket cylinders, as well as between the blanket cylinder with the impression cylinder at each color station or each color head.

Moreover, the plate cylinder relative to the blanket cylinder and the pair of plate and blanket cylinders relative to the impression cylinders, cannot be maintained at a fixed position but, rather, must be moveable relative to each other between an impression position in order to appropriately mount new plates onto the plate cylinders, new blankets on the blanket cylinders and also, to accommodate the thickness of the plates and, further, to appropriately provide an amount of pressure according to the number or density of color dots required for a given color strength and for a particular printing job.

The plate and blanket cylinder are designed to be of equal diameter and the blanket cylinder is sometimes provided with a corresponding groove across its width. On impression, the plate cylinder and blanket cylinder are brought into rolling contact under pressure and the blanket cylinder is brought into rolling contact under impression pressure against the impression cylinder. Even where the bearings and axles are made with a close tolerances and high strength, the amount of pressure across the entire surface of the plate and blanket cylinder is substantial. The rolling contact pressure is often adjusted in terms of the width or thickness of a "stripe" or line across the surface of the contacting cylinders. During makeready, impression pressure is applied with the press stopped, so that the ink and dampening fluid is completely flattened or squeezed off, and it appears to be absent in an area of a stripe across the surface of the cylinders. A thinner stripe corresponds to lighter pressure and a thicker stripe indicates more pressure. When the plate gap rolls past the blanket cylinder, or rolls into a rotary position adjacent to a corresponding blanket gap in the blanket cylinder, the two cylinders, no longer push against each other and they tend to move toward each other slightly, reducing the pressure on the impression cylinder and causing a light print area or a streak. When the cylinders rotate to the other edge of the gap, the cylinders then must move quickly away from each other as the surface-to-surface rolling contact is reinitiated. This can cause a vibration and also can cause a corresponding bounce or chatter, slurring or skipping due to a reduction in pressure and reinitiation of pressure between the blanket cylinder and the impression cylinder. When this change in rolling contact pressure is great, streaking, skipping, bouncing or chattering can adversely and noticeably affect the quality of the print. Even when the change in impression pressure is small, it can less perceivably affect the accuracy of registration of the sets of image-forming dots so that a lack of clarity and precision of the total image can result. This is sometimes referred to as "slurring." If one color head does not continuously and properly align with the sets of dots for another color head, the image will not be sharp, the color blend will not be true or the image may be blurred or slurred.

In the past, to correct this and to reduce the movement of the plate cylinder with respect to the blanket cylinder and the corresponding change in impression pressure, some press manufacturers have produced circular plates rigidly affixed at either end of the plate and blanket cylinder. The circular plates are machined with a close tolerance and are accurately mounted concentric with the cylinder surfaces to provide a continuous rolling contact. While this prior system avoids the chattering problem, it creates its own problem in that the amount of pressure between the plate and blanket cylinder cannot be easily adjusted from one printing job to the next or cannot easily accommodate printing plates of even slightly different thickness. An experienced press operator can adjust the contact with this type of direct rolling contact end plates by wrapping the plate cylinder with a thin shim sheet of paper prior to attaching the photosensitized printing plate. This takes a substantial amount of time and it is not usually warranted for short runs. Even in instances where the press operator takes the time to remove the plate and install different thicknesses of shim sheets until the desired pressure between the two plates is obtained, Also, it will be seen when the plate cylinder is packed, the blanket will usually also be packed to keep the cylinders the same size. The blanket cylinder is typically gear-driven from the impression cylinder and the plate cylinder is gear-driven from the blanket cylinder. If their rolling diameters are not identical, then the one-to-one rolling contact intended by the gear drive is not necessarily achieved and slippage or slight sliding and blurring between the surface can result.

The adjustment of the pressure between the plate cylinder and the blanket cylinder is often referred to as adjusting the stripe thickness or width. Under pressure the line of contact or flattened ink between one cylinder surface and the other cylinder surface may be wider or narrower, depending on how much pressure there is between the two cylinders. This is often, then, referred to as "adjusting the stripe." A stripe in a range of ⅛" to about ⅜" might be acceptable, depending upon the press and printing job. An experienced press operator can appropriately adjust the stripe width, depending upon factors such as the density of printing of a particular color, the thickness or viscosity of the ink being used and the amount of dampening fluid applied. The stripe is generously proportional to the contacting force or rolling pressure and should normally be the same from one end of the cylinders to the other end.

It can be important to maintain proper printing and registration to adjust the stripe width, yet it is also desirable to avoid the change in pressure caused when each plate connection channel rolls unopposed past the blanket cylinder.

OBJECTS AND ADVANTAGES OF THE PRESENT INVENTION

Thus, it is an object of the present invention to provide adjustable spacing between the plate cylinder and the blanket cylinder and yet to avoid or to minimize the effect of changing pressure or the movement of the cylinders toward and away from each other when the plate gap, for clamping the plate to the plate cylinder and the blanket gap, for clamping the blanket to the blanket, roll past each other.

Thus, it is a beneficial aspect of the present invention to provide a mechanism to adjust the amount of pressure and also to maintain a constant maximum pressure throughout the rotation of the cylinders through a print cycle.

It is a further object to provide a mechanically reliable and economic mechanism that can adjustably set an even pressure across the plate and blanket cylinder and the to allow adjustment of the pressure equally across the cylinders and to then maintain a constant rolling pressure throughout the printing cycle even where the plate cylinder and blanket cylinder have gaps across the surfaces for accommodating the printing plate fastening mechanism that holds the photosensitized plate in an appropriate position on the plate cylinder and for accommodating the blanket fastening mechanism that holds the image transferring blanket in position on the blanket cylinder, respectively.

SUMMARY OF THE INVENTION

The present invention overcomes the drawbacks of the prior presses without bearer disks formed on either end of the plate and blanket cylinders and further overcomes the lack of adjustability of bearer systems in which precision ground, hardened plates are formed or attached on the ends of each cylinder to maintain a constant distance between the plate and blanket cylinder. The present invention provides adjustable link arm mechanisms, including link arm pairs, one arm journaled to the axles of the plate and blanket cylinders adjacent to both ends of the cylinders. The link arms are connected to each other at a mutual pivot point. The pivot point is at a distance offset from a line drawn between the centers of the plate cylinder axle and the blanket cylinder axle. On the other side of the imaginary line, projections from the two link arms are adjustably moveable toward or away from each other to pivot the link arms and thereby increase or decrease the minimum distance between the two axles. Thus, the maximum rolling force is fixed by setting the minimum distance between the two cylinders. A spring mechanism provides the arms with a capability of pivoting to a larger distance so that the cylinders can be moved away from each other to a "makeready" position for replacing the plate, replacing the blanket or for cleaning the cylinders for the next printing job. Yet, under impression, the distance that the plate cylinder axle and the blanket cylinder axle can move toward one another is stopped by the link arm mechanism at an adjustably fixed distance. The unique link arm mechanism also permits separate adjustment for either end of the cylinders. In one embodiment, once the two ends are adjusted to be at an equal distance, both ends can be adjusted equal amounts simultaneously to increase or decrease the stripe width equally entirely across the cylinders.

BRIEF DESCRIPTION OF THE DRAWINGS

The foregoing objects, advantages, and features, as well as other objects and advantages, will become more apparent with reference to the description and drawings below, in which like numerals represent like elements and in which.

DETAILED DESCRIPTION OF THE PREFERRED EMBODIMENTS

Figure 1:
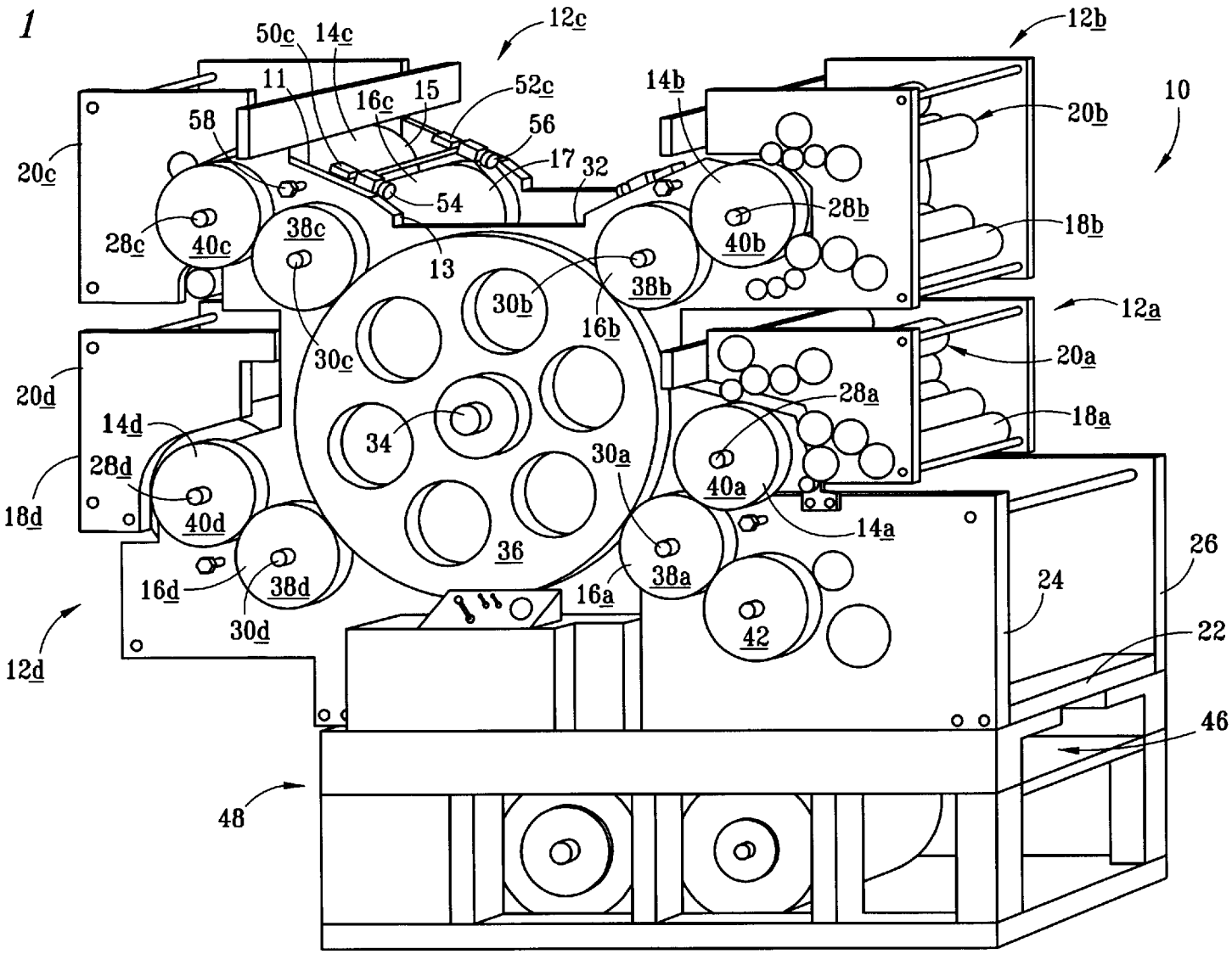
FIG. 1 is a perspective view of a multiple color, offset rotary printing press, having adjustable link arms positioned between the plate and blanket cylinders according to the present invention.

FIG. 1 shows a side perspective view of a multiple color rotary offset printing press 10, including multiple color print heads or printing stations 12(*a*), (*b*), (*c*) and (*d*). Each of the print heads 12 include a plate cylinder 14(*a*), (*b*), (*c*) and (*d*), and also a blanket cylinder 16(*a*), (*b*), (*c*) and (*d*). Under each print head 12(*a*)–(*d*) also include a set of inking rollers 18(*a*)–(*d*) and a dampening roller system 20(*a*)–(*d*).

The plate cylinders and blanket cylinders 14(*a*)–(*d*) and 16(*a*)–(*d*), respectively, are mounted to a press frame 22, having front 24 and back 26 frame members, generally defining parallel planes at which the plate cylinders 14 and blanket cylinders 16 are mounted through plate cylinder axles 28(*a*)–(*d*) and blanket cylinder axles 30(*a*)–(*d*), respectively. An impression cylinder 32 is also rotatably mounted to front 24 and back 26 frame members through an impression cylinder axle 34. The impression cylinder 32 is connected through axle 34 to an impression drive gear 36. The impression drive gear 36 engages with blanket cylinder gears 38(*a*)–(*d*), each of which, in turn, engage with plate cylinder gears 40(*a*)–(*d*), respectively. When the press 10 is operating in the impression mode, each blanket cylinder 16 is moved into rolling control pressure engagement with the impression cylinder 32. The impression cylinder carries grippers in gaps that hold on its surface the paper sheets to be printed. The plate cylinders 14 are also engaged with rolling contact pressure with blanket cylinders 16. The impression gear 36 is engaged with the blanket cylinder gears 38 which, in turn, are engaged with plate cylinder gears 40 for direct drive rolling contact between impression cylinder 32 and the blanket cylinders 16 and, in turn, between blanket cylinders 16 and the impression cylinders 14. Other gears, such as feed gear 42, may also be appropriately engaged for sheet feeding through sheet feeder 46 so that sheets to be printed can be gripped at printing stations 44 (not shown) circumferentially around impression roller 32. The sheets to be printed are rotated through and past each printing station 12(*a*)–(*d*) for adding each color printing and for subsequent removal and collection in sheet collection area 48.

To facilitate and maintain accurate spacing and registration between each of the plate cylinders 14 and corresponding blanket cylinders 16, according to the present invention, a first inventive link arm mechanism 50 is connected between plate cylinder axles 28 and blanket cylinder axles 30 between the front frame member 24 and front ends 11 and 13 of plate cylinder s 14 and blanket cylinders 16, respectively. A second link arm mechanism 52 is also positioned between back frame member 26 and the back ends 15 and 17 of plate cylinders 14 and blanket cylinders 16, respectively. The link arm mechanisms are adjustable to set the minimum spacing between the plate cylinders 14 and the blanket cylinders 16. The minimum spacing is maintained throughout an entire impression rotation cycle. The link arm mechanisms 50 and 52 are desirably positioned at opposite ends of the plate cylinder and blanket cylinders at each of the plurality of color printing heads or color printing stations. Each link arm mechanism 50 and 52 is preferably provided with a separate adjustment mechanism 54 and 56 for separately adjusting the spacing between the plate cylinders 14 and blanket cylinders 16 at the front ends 11 and 13 and also for separately adjusting the spacing of the plate 14 and blanket 16 cylinders at the back ends 15 and 17, respectively.

Also, advantageous in a preferred embodiment, a control rod 58 is attached and traverses across the press 10 from the front end adjustment mechanism 54 of first link arm mechanism 50 to the back end adjustment mechanism 56 of second link arm mechanism 52. The control rod 58 is constructed for simultaneously changing cylinder-to-cylinder spacing caused by first link arm 50, as well as the spacing caused by second link arm 52, in exactly the same amount. This contrasts to the individual adjustment mechanisms 54 and 56, which allow the spacing at the front ends to be adjusted separately from the spacing at the back-ends link arm 52.

Figure 2:
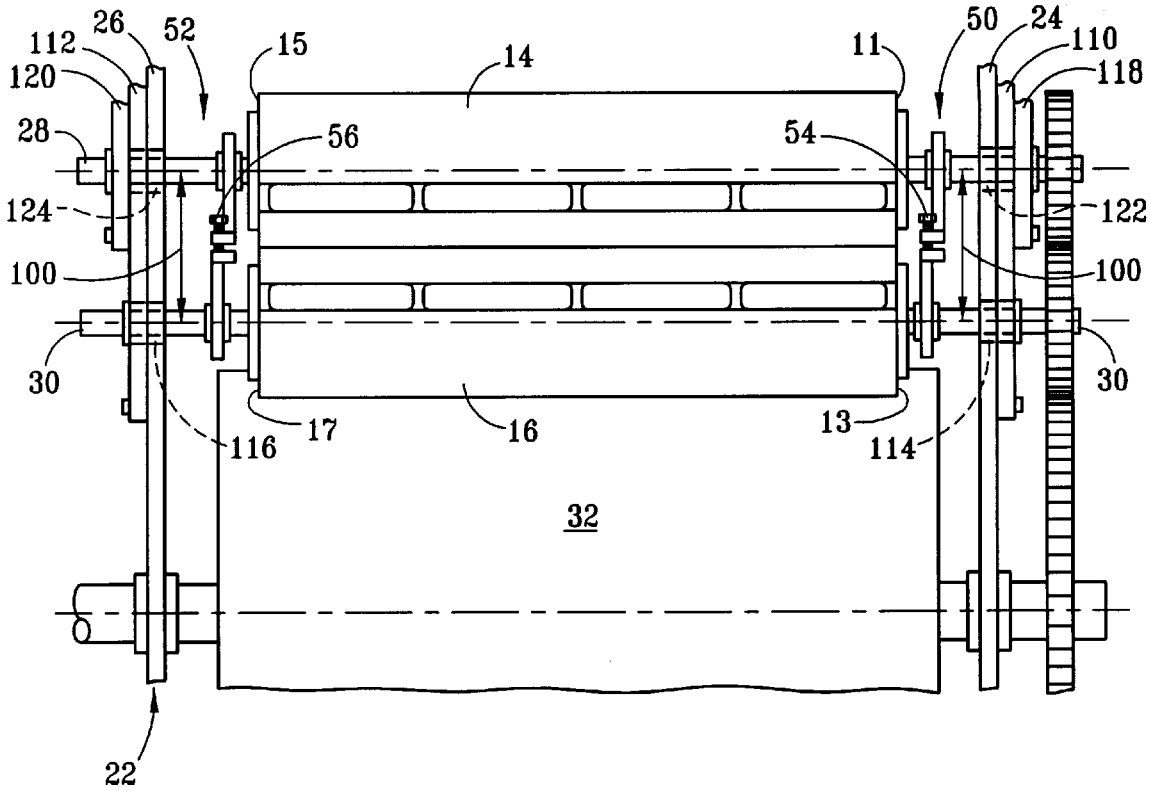
FIG. 2 is a schematic partial cutaway plan view of a plate cylinder, blanket cylinder and impression cylinder mounted for rotation in a frame of a printing press according one embodiment of the present invention, showing the position of the pairs of adjustable link arms immediately adjacent either end of the plate cylinder and blanket cylinder and positioned inside of the printing press frame.

FIG. 2 is a schematic partial cutaway plan view of a plate cylinder 14, blanket cylinder 16 and impression cylinder 32 mounted for rotation in a frame 22, between frame members 24 and 26, of a printing press 10, according to one embodiment of the present invention. The position of pairs of adjustable link arms 50 and 52 are immediately adjacent either end of plate cylinder 14 and blanket cylinder 16, and are positioned inside of the printing press frame. In the embodiment depicted in FIG. 2, the blanket cylinder is journaled to a pair of pressure application arms 110 and 112, so that they may move into and out of impression contact with impression cylinder 32 wherein axle 30 moves relative to frames 24 and 26 in slots 114 and 116, respectively. Similarly, plate cylinder 14 is attached to frame 24 and 26 through pressure application members 118 and 120 which are moveable within slots 122 and 124, cut through frame members 24, 26 and also through blanket cylinder pressure application members 110 and 112. The slots and pressure arms are only schematically depicted, as different presses use different mechanisms for applying the impression pressure between the blanket cylinder 16 and the impression cylinder 32, as well as the image transfer pressure between plate cylinder 14 and blanket cylinder 16.

An important aspect, with respect to the present invention, is that the link arm mechanisms 50 and 52, including the pairs of pivotably attached link arms, may pivot outwardly away from the adjustable stops 54 and 56, but are prevented from moving inwardly beyond the minimum adjusted distance 100 between axles 28 and 30. Also, importantly, the close proximity of the locations between the link arms 50 and 52 and the ends of plate cylinder 14 and blanket cylinder 16 reduces any flexure that may otherwise occur in the connection between the axles 28 and 30 and the frame member 24 and 26.

Figure 3:
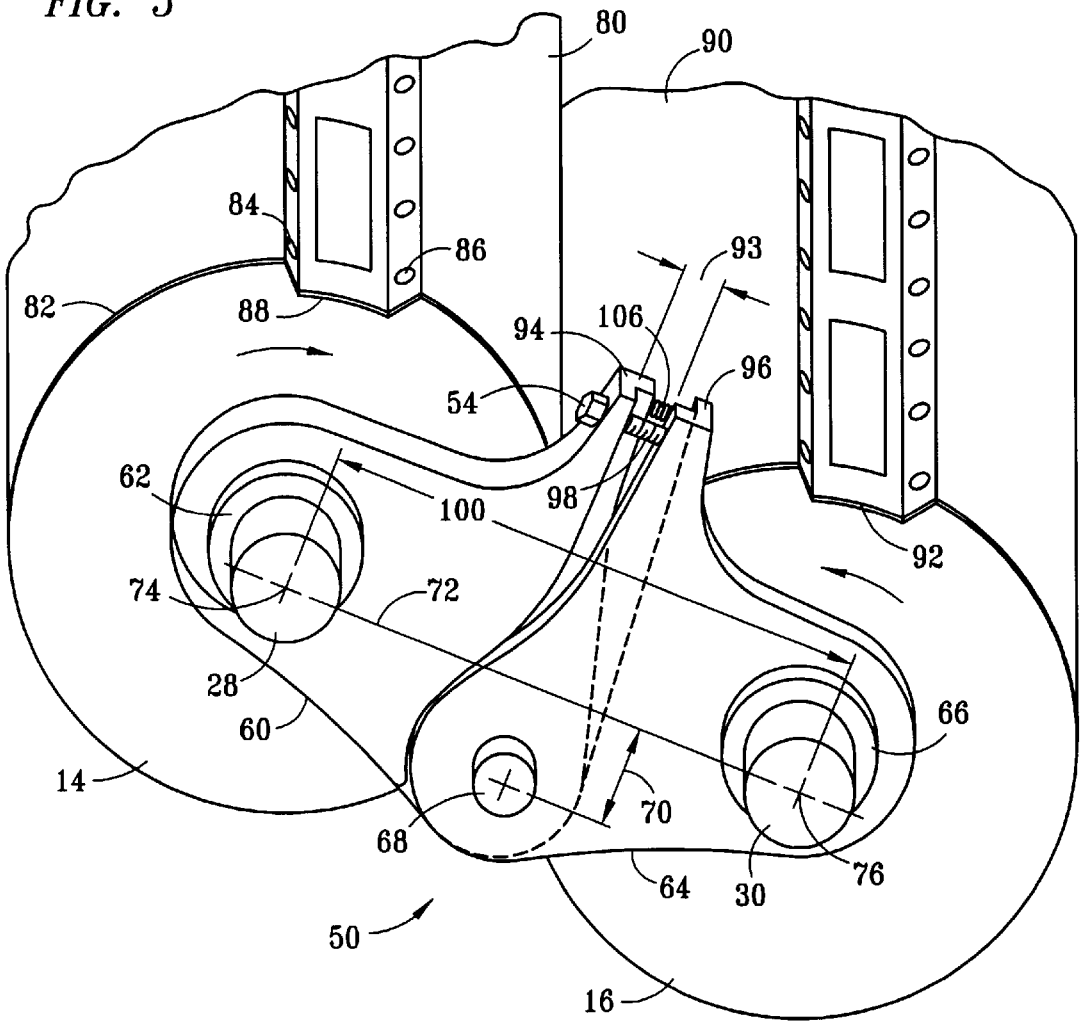
FIG. 3 is a perspective view of a plate cylinder and blanket cylinder with adjustable link arms positioned therebetween according to one embodiment of the present invention in which duplicate pairs of link arms would be positioned on either side of the plate and blanket cylinders.

FIG. 3 is a partial perspective view of a plate cylinder 14 and a blanket cylinder 16 with adjustable link arms 50 connected between plate cylinder axle 28 and blanket cylinder axle 30, according to one alternative embodiment of the present invention. The link arm mechanism 50 further comprises a pair of link arms 60 and 64. A first link arm 60 is rotatably connected to the plate cylinder axle 28 through a first bearing 62. A second link arm 64 is connected to the blanket cylinder axle 30 through a second bearing 66. Both link arms are pivotably interconnected at a single axis pivot 68. The link arms 60 and 64 are constructed so that pivot 68 will be a spaced-apart distance 70 from an imaginary line 72 drawn between centers 74 and 76 of plate cylinder axle 28 and blanket cylinder axle 30, respectively. When the plate cylinder 14 and blanket cylinder 16 are in the impression rolling contact for printing the offset distance 70 is advantageously more than about 5% of the diameter of the cylinders. Preferably, for 6¾" diameter cylinders, the offset 70 is more than about ½", i.e., preferably more than about 7.5% of the diameter of the plate cylinder for the blanket cylinder and less than about 50% of the diameter of the cylinders.

It will be seen in FIG. 3 that the rolling contact between the plate cylinder 14 and the blanket cylinder 16 is, in fact, rolling contact between the surface 80 of a photosensitized plate 82 secured at a leading edge 84 and also secured at a trailing edge 86 into a plate-securing gap 88. Surface 80 of plate 82 is in contact with blanket cylinder surface 90 under impression and less than about 50%. The blanket cylinder may be provided with a corresponding blanket-securing gap 92 that is synchronized through the direct gearing (not shown in FIG. 3) to correspond during rotation to overlap plate gap 88. The plate gap 88 and blanket gap 92 present a void and lack of surface 80 to surface 90 rolling contact such that rolling pressure between plate cylinder 14 and blanket cylinder 16 would be unopposed during that segment of rotation. Any play or flexure slack in the bearings, in the pressure application arms or in the mounting mechanism to frames 24 and 26 can produce movement. Any flexing in the axles will be amplified over the distance the cylinders are spaced from the frame members 24 and 26. Thus, the lack of rolling contact may cause the blanket cylinder and plate cylinder to move toward each other as the gaps 88 and 92 are traversed and away from each other as leading edge 84 reinitiates contact between surface 80 and surface 90. However, with the link arms 60 and 64 rotatably journaled at 62 and 66 in place on axles 28 and 30, rigidly pivoted at single axis pivot point 68, and provided with adjustment device 54 for adjustable spacing of distance 93, the movement of the cylinders is minimized or avoided. Thus, because there are two points of contact, namely at pivot 68 and at adjustment mechanism 54, the minimum distance 100 between axles 28 and 30 becomes adjustably fixed. In the embodiment depicted, adjustment mechanism 54 is shown as a bolt 98 threadably engaged through projection 94 and abutting against a surface of projection 96. Other adjustment mechanisms might be used without departing from certain aspects of the invention provided that the adjustment can be fixed at the desired spacing throughout the impression cycle of the print head.

It will be noted, however, that because the link arms 60 and 64 may pivot, at 68 about a single axis parallel to the cylinder axles, to away from the abutting contact of bolt 98 with projection 96, the distance between axles 28 and 30 may be increased during makeready without adjusting mechanisms 50 or 54, so that the photosensitized printing plate 82 may be removed and replaced. The blanket may be replaced in blanket cylinder 16 or the cylinders may be cleaned and the press may be maintained or repaired as needed to make it ready for the next printing job.

Figure 4:
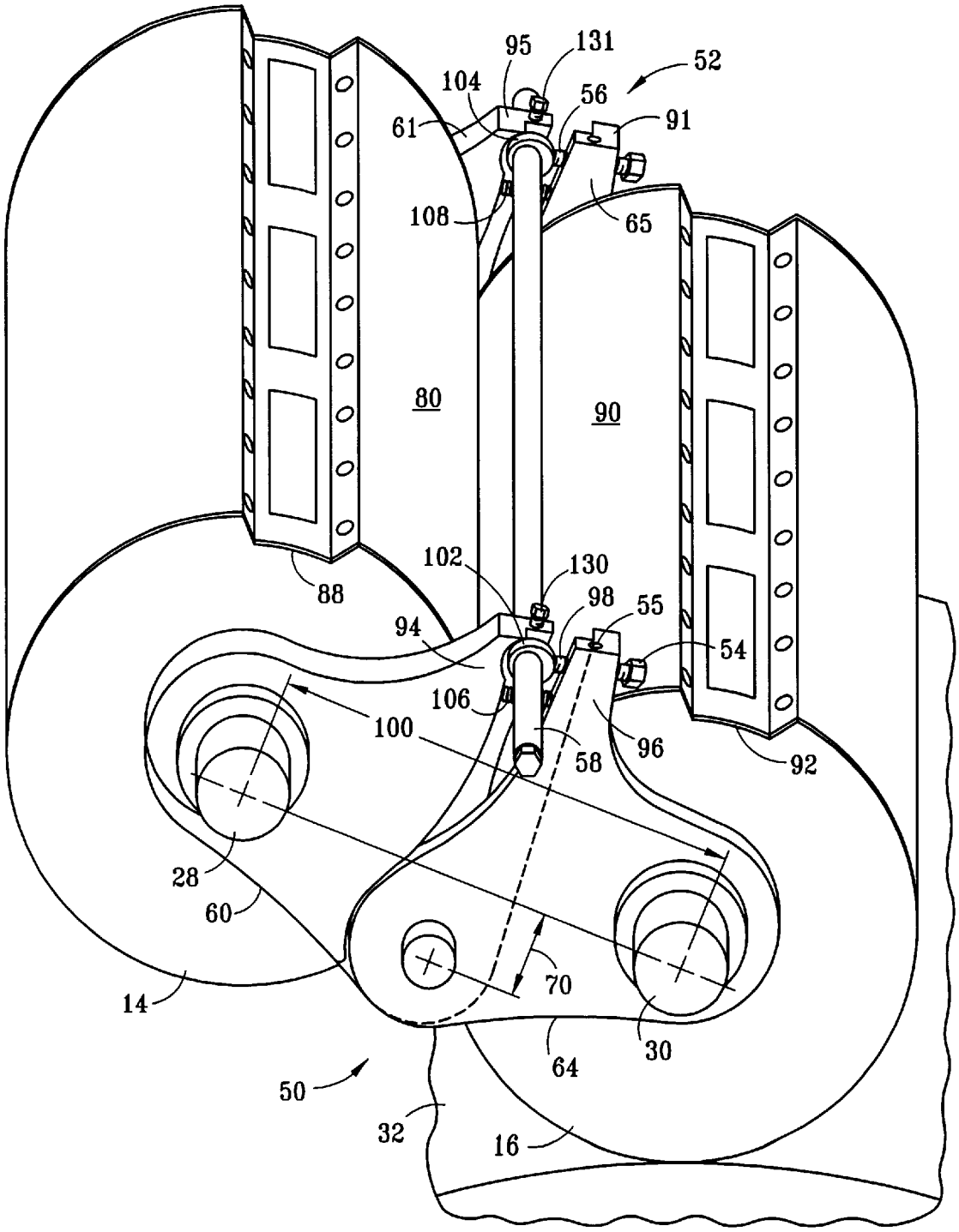
FIG. 4 is a depiction of a plate and blanket cylinder having a pair of adjustable link arms positioned on either end and further including an adjusting rod having dual cams thereon for adjusting both ends of the plate and blanket cylinders at the same time.

In FIG. 4, an alternative embodiment of the inventive link arm mechanism is disclosed as a pair of adjustable link arms positioned on either end of plate cylinder 14 and blanket cylinder 16. In this embodiment, the link arm mechanism 50 is on one end and the link arm mechanism 54 is on the other end of the cylinders. Link arm mechanism 50 includes a first link arm 60 rotatably mounted on axle 28 of plate cylinder 14 and a second link arm 64 rotatably attached through bearing 66 to axle 30 of blanket cylinder 16. Blanket cylinder 16 is shown in rolling impression contact with impression cylinder 32 and also in rolling contact with the surface of plate cylinder 14. The adjustment mechanism 54 can be used to establish the minimum distance 100 between the centers of axles 28 and 30, both on link arm mechanism 50 and the opposite end link arm mechanism 52. When a consistent stripe width is set at both ends using the independent or separate adjustment mechanisms 50 and 54, the position may be secured in place, as with a locking nut or a set screw 55, as shown. For example, when the width of the stripe is consistent across the entire axial length of surfaces 90 and 80, then both ends may be equally adjustably spaced simultaneously using control rod 58.

In the embodiment schematically depicted in FIG. 4, control rod 58 comprises a rod extending from the front ends to the back ends of cylinders 14 and 16. Control rod 58 is rotatably engaged in one projection 94 of one of the arms 60 of link arm mechanism 50 and no projection 95 of one of the arms of link arm mechanism 52. Upon turning control rod 58, an eccentric 102 and an eccentric 104, both identically sized and aligned, rotate against separate adjustment mechanisms 54 and 56 so that both ends of the plate cylinder and blanket cylinder are provided with the same minimum spacing distance 100. The control rod 58 can be locked in place at a set adjustment with a set screw 130 or 131.

When the press is placed in a makeready condition, the pressure is released between blanket cylinder 16 and impression cylinder 32. The pressure is also released between blanket cylinder 16 and plate cylinder 14. The link arm 60 pivots at pivot 68 with respect to link arm 64 so that the increase in distance between the axles 28 and 30 is accommodated. This will occur automatically through the use of a compression spring 106 held in position between projection 94 and 96 of link arm mechanism 50 and a compression spring 108 held in position between projections 95 and 97 of link arm mechanism 52.

Figure 5:
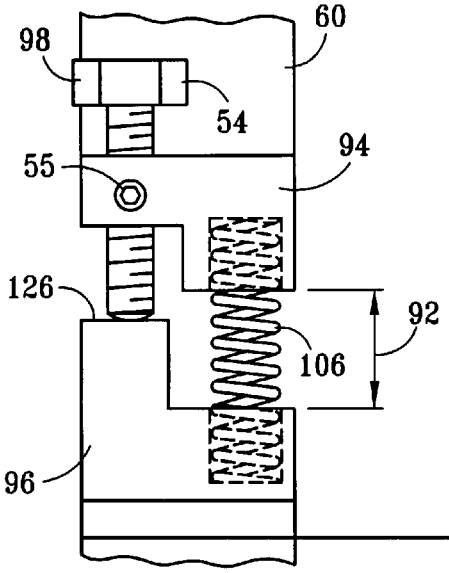
FIG. 5 is an enlarged partial cutaway top plan view of one pair of adjustable link arms corresponding to the link arms of FIG. 3.

FIG. 5 is a schematic cutaway plan view of the separate adjustment mechanism according to the embodiment depicted in FIG. 3. The adjustment mechanism 54 comprises a bolt 98 threadably engaged through projection 94 of link arm 60. The bolt 98 abuts against a surface 126 of projection 96 and is locked in place, as with a set screw 55, to maintain a fix, after adjustment, minimum separation distance 92. A compression spring 106 is appropriately positioned and secured between projections 94 and 96, so that upon makeready, when the blanket cylinder and plate cylinder are separated from one another, the projections 94 and 96 are pushed into separation by compression spring 106. When the impression pressure is again applied, the compression spring 106 compresses, but it cannot compress beyond the minimum distance 92, as fixed by adjustment mechanism 54. The blanket cylinder and plate cylinder will not be able to move toward each other any closer than the minimum distance 100 thus established.

Figure 6:
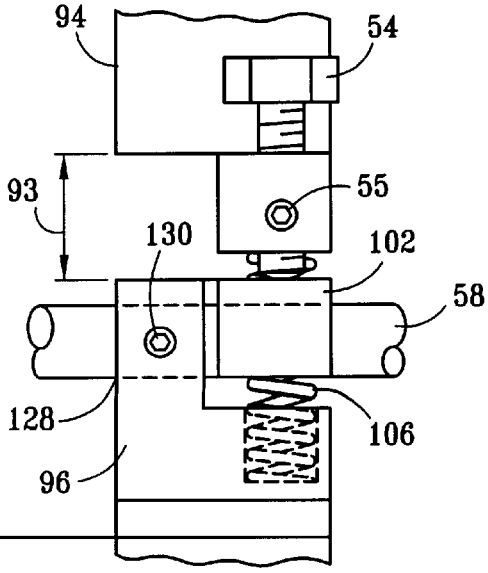
FIG. 6 is an enlarged partial cutaway top plan view of one pair of adjustable link arms with one of the dual cam adjusters depicted according to the embodiment depicted in FIG. 4 of the present invention.

FIG. 6 is a schematic partial cutaway top plan view of projections 96 and 94 of link arm mechanism 50 according to the embodiment depicted in FIG. 4. The separate adjustment mechanism 54 is a bolt 98 having threadably engaged through projection 94 and having mechanism 50 as a set screw 55. A portion of the control rod 58 is shown journaled at 128 through a portion of projection 96. The locking mechanism bolt 98 is adjustably positioned for contact against a cam surface or eccentric 102 so that link arm mechanisms at both ends of the cylinders can be simultaneously adjusted equal amount with the control rod 58. A lock mechanism 130 may also be provided, such as a set screw 130, to precisely maintain the minimum separation distance 93 between projections 94 and 96 so that the minimum adjusted distance 100 between axles 28 and 30 will also be maintained. Compression spring 106 is positioned between projections 94 and 96 so that the separation distance between projections 94 and 96 increases when the press is moved into a makeready condition and the spring is compressed when the press is moved into a printing or impression pressure condition.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A link mechanism for maintaining minimum spacial distance between a plate cylinder and a blanket cylinder of a rotary printing press, said link mechanism comprising:

a) a first link arm rotatably mounted on an axle of said plate cylinder at one end of said plate cylinder;

b) a second link arm rotatably mounted on an axle of said blanket cylinder at a corresponding blanket cylinder; and c) said first link arm and said second link arm forming a pair of link arms pivotably connected to each other for single axis pivoting about a single axis parallel to the plate cylinder and blanket cylinder axles through a point on one side of an imaginary line drawn through centers of said plate cylinder axle and said blanket cylinder axle and having an adjustment mechanism positioned between the link arms on the other side of said imaginary line so that a minimum spacial distance between said plate cylinder axles and said blanket cylinder axle can be adjustably set and maintained throughout an impression rotation of said plate and blanket cylinders.

2. The link mechanism of claim 1 further comprising another pair of said first and second link arms on another end of said plate cylinder and said blanket cylinder of said rotary printing press.

3. The link mechanism of claim 2 further comprising a separate mechanism for adjustment of the spacing between each of said pairs of link arms so that a desired relative "stripe" thickness indicating consistent rolling contact pressure between said plate and blanket cylinder can be adjustably set at either end across the width of said plate and blanket cylinder.

4. The link mechanism of claim 3 further comprising a control rod having dual cams for simultaneously adjusting the spacing of said link arms on both ends of said plate and blanket cylinders.

5. The link mechanism of claim 1 wherein said offset distance of said single axis pivot point of said first and second link arms is at a distance from said imaginary line drawn between axle centers greater than about 5% of the diameter of the plate cylinder.

6. The link mechanism of claim 1 wherein said single axis pivot point of said first and second link arms is at a distance, from said imaginary line drawn between axle centers, greater than about 7.5% of the diameter of the plate cylinder.

7. A multiple color head offset rotary printing press having an impression cylinder and a plurality of plate cylinders and blanket cylinders, one for each color to be printed, said printing press further comprising:

a) a first link arm rotatably mounted on an axle at one end of each of said plurality of plate cylinders;

b) a second link arm rotatably mounted on an axle at a corresponding one end of each of said blanket cylinders; and c) said first link arm and said second link arm forming a pair of link arms pivotably connected to each other for pivoting about a single axis parallel to the plate cylinder and blanket cylinder axles through a point on one side of an imaginary line drawn through centers of said plate cylinder axle and said blanket cylinder axle and having an adjustment mechanism positioned between the link arms on the other side of said imaginary line so that a minimum spacial distance between said plate cylinder axles and said blanket cylinder axle can be adjustably set and maintained throughout an impression rotation of said plate and blanket cylinders.

8. The multiple color head offset rotary printing press of claim 7 further comprising another pair of said first and second link arms on another end of each of said plurality of said plate cylinders and said blanket cylinders of said rotary offset printing press.

9. The multiple color head offset rotary printing press of claim 8 further comprising a separate mechanism for adjustment of the spacing for each of said pairs of link arms so that a desired relative "stripe" thickness indicating consistent rolling contact pressure between said plate and blanket cylinders can be adjustably set at either end across the width of said plate and blanket cylinders.

10. The multiple color head offset rotary printing press of claim 9 further comprising a control rod having dual cams for simultaneously adjusting the spacing of said link arms on both ends of each of said plurality of said plate and blanket cylinders.

11. The multiple color head offset rotary printing press of claim 7 wherein a distance of said single axis pivot point of said first and second link arms from said imaginary line drawn between axle centers is greater than about five percent of the diameter of the plate cylinders.

12. The multiple color head offset rotary printing press of claim 7 wherein a distance of said single axis pivot point of said first and second link arms from said imaginary line drawn between axle centers is greater than about 7.5% of the diameter of the plate cylinders.

* * * * *